US006279762B1

(12) United States Patent
Buchalter et al.

(10) Patent No.: US 6,279,762 B1
(45) Date of Patent: Aug. 28, 2001

(54) KNOCKDOWN FRAME STORAGE SYSTEM

(75) Inventors: Mark A. Buchalter, E. Grand Rapids; Jim Tappel, Hickory Corners; George J. Simons, Jr.; Lawrence L. Laske, both of Grand Rapids, all of MI (US)

(73) Assignee: Steelcase Development Corporation, Caledonia, MI (US)

( * ) Notice: Subject to any disclaimer, the term of this patent is extended or adjusted under 35 U.S.C. 154(b) by 0 days.

(21) Appl. No.: 09/524,346

(22) Filed: Mar. 13, 2000

(51) Int. Cl.[7] ..... B42F 15/00

(52) U.S. Cl. ..... 211/189; 211/46; 248/175; 312/187

(58) Field of Search ..... 211/189, 46; 312/184; 248/165, 175, 153

(56) References Cited

U.S. PATENT DOCUMENTS

| | | | | |
|---|---|---|---|---|
| D. 285,016 | | 8/1986 | Claydon . | |
| D. 366,744 | | 1/1996 | Bailey . | |
| D. 369,621 | | 5/1996 | Krayer, Jr. et al. . | |
| 2,746,823 | * | 5/1956 | Sand | 248/188 X |
| 3,391,698 | | 7/1968 | Wiles . | |
| 3,722,561 | | 3/1973 | O'Leary et al. . | |
| 4,316,644 | | 2/1982 | Johnson . | |
| 4,413,800 | | 11/1983 | Kelson . | |
| 4,526,277 | * | 7/1985 | Snowden et al. | 211/46 |
| 4,527,694 | * | 7/1985 | Bolt et al. | 211/46 |
| 4,646,802 | | 3/1987 | Basore et al. . | |
| 4,856,660 | * | 8/1989 | Selwyn-Smith | 211/46 |
| 4,915,248 | | 4/1990 | Chap . | |
| 4,921,195 | | 5/1990 | Clark et al. . | |
| 4,960,307 | | 10/1990 | Nelsen . | |
| 4,969,568 | * | 11/1990 | Yoshida | 211/189 X |
| 5,016,765 | * | 5/1991 | Leonardo | 211/189 |
| 5,405,020 | * | 4/1995 | Fotioo | 211/46 |
| 5,579,703 | * | 12/1996 | King | 211/189 X |
| 5,971,166 | * | 10/1999 | Ong | 211/46 |
| 6,161,808 | * | 12/2000 | East et al. | 211/189 X |
| 6,168,031 | | 1/2001 | Schmidt | 211/46 |

* cited by examiner

*Primary Examiner*—Daniel P. Stodola
*Assistant Examiner*—Erica B. Harris
(74) *Attorney, Agent, or Firm*—Price Heneveld Cooper DeWitt & Litton

(57) ABSTRACT

The storage system includes a universal frame adapted to support different inserts, such as a hanging folder, a hanging sling, and a hanging box-shaped insert and is adapted to be supported by various supports, such as bent-wire snap-attach legs, a panel bracket, and rigid box support. The storage system is knockdown and reconfigurable by a user, and thus provides flexibility of use, while taking advantage of common parts. Further, the system can be flexibly used in existing offices having shelves.

17 Claims, 4 Drawing Sheets

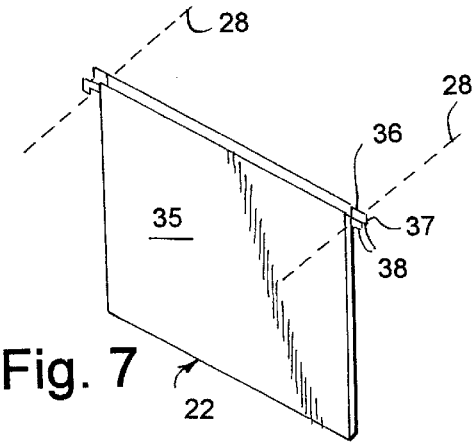
Fig. 7
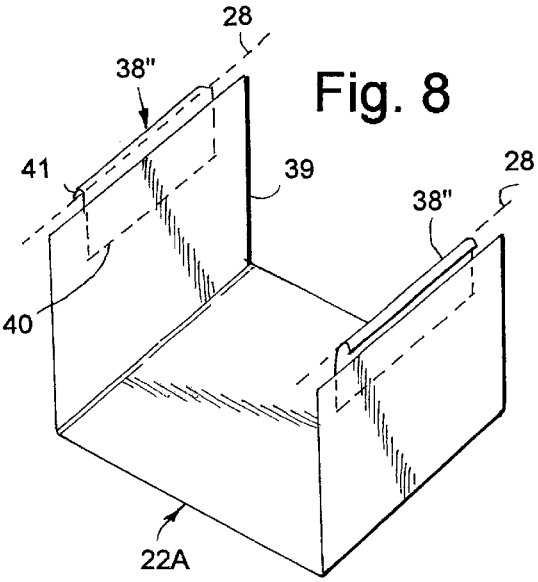
Fig. 8
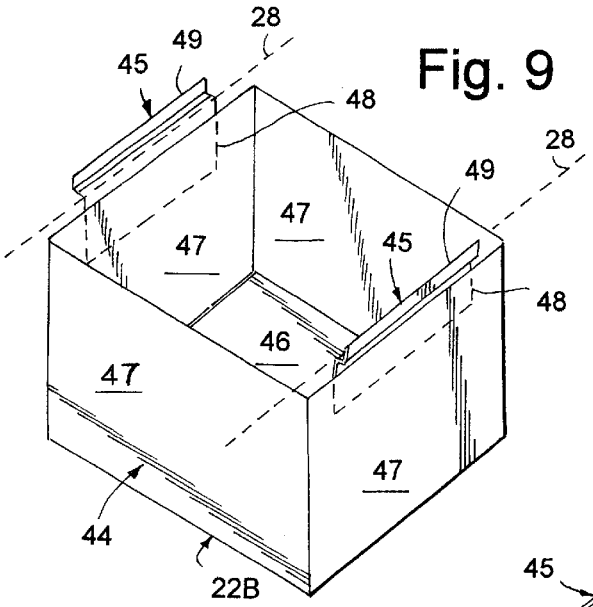
Fig. 9
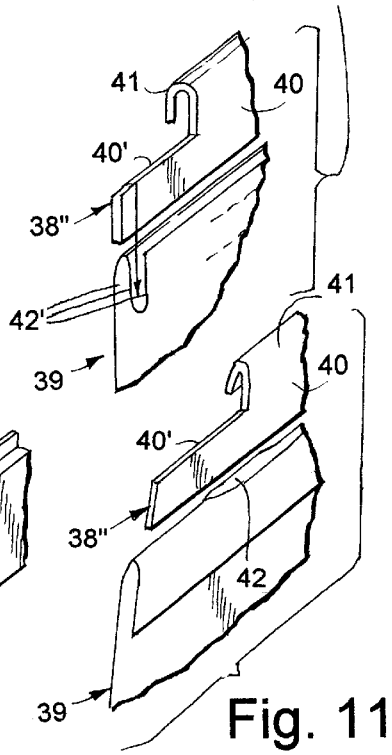
Fig. 10
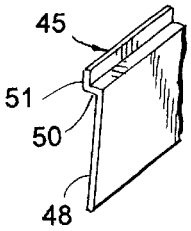
Fig. 12
Fig. 11

KNOCKDOWN FRAME STORAGE SYSTEM

BACKGROUND

The present invention relates to storage systems, and more specifically relates to a knockdown frame storage system having a universal frame, different inserts for the frame to allow storage of different items, and different support structures for supporting the frame.

Traditional office furniture and accessories provide for hidden storage of files, such as in drawers and in other semi-hidden locations. In traditional furniture, the devices providing the storage are typically permanently attached or otherwise constructed for a specific location or use, such that they are not easily reconfigurable to meet changing office needs or preferences. Sometimes the traditional office furniture can be disassembled and reassembled in different configurations, but this requires a skilled maintenance person, tools, and substantial time. Further, once reconfigured, the files are still not positioned for easy access or efficiency.

A storage system is desired that is low cost, flexible, and able to deal with high volumes of paper, yet that provides high visual and physical accessibility, and that is easily reconfigurable by a user to meet constantly changing needs and for maximum efficiency. Preferably, such a system would allow access to groups of files so that they can be quickly retrieved and taken as a group to meetings at locations removed from the workstation. Such a system preferably would emphasize visual access, organization, rearrangeability and customizability for maximum worker control.

Accordingly, a storage system is desired solving the aforementioned problems and having the aforementioned advantages.

SUMMARY OF THE INVENTION

In one aspect of the present invention, a storage system is provided for supporting items in a hanging folder. The storage system includes a unitary frame defining a planar geometric shape with sides, with at least two of the sides having an up flange adapted to support opposite edges of the hanging folder, and with the geometric shape further including corners with an attachment feature. Legs are provided that are configured to releasably engage the attachment feature and support the unitary frame above a support surface in a freestanding arrangement. The legs have a length long enough to support the unitary frame above the support surface so that the folders will not touch the support surface but instead will hang within the unitary frame.

In another aspect of the present invention, a storage system includes a unitary frame defining a geometric shape with sides, with at least two of the sides having up flanges adapted to support hanging inserts. A plurality of hanging inserts is shaped to fit into and hang from the unitary frame. Each hanging insert has a pair of attachment members adapted to engage the up flanges. The plurality of hanging inserts includes a hanging folder with a folded stiff material forming a thin pocket for papers, a sling including a strip of flexible material that drapes between the at least two sides when placed in the unitary frame, and a box-shaped holder with four sides in the bottom configured to form a contained arrangement within the unitary frame.

In another aspect of the present invention, a storage system includes a unitary frame having a first up flange adapted to support hanging folders. A first insert has a container member configured to sit within the universal frame. The first insert further has a first attachment member configured to engage and rest on the first up flange. The first attachment member has a second up flange configured to replicate the first up flange. A plurality of second inserts each have a second attachment member configured to engage and selectively rest on either one of the first up flange and the second up flange. The container member of the first insert is configured to contain and hold the plurality of second inserts together and is removable from the unitary frame so that the plurality of second inserts can be taken as a unit to a location separate from the unitary frame.

In another aspect of the present invention, a storage system includes a perimeter frame having a first flange adapted to engage and support hanging folders. A first insert has a container member configured to set within the perimeter frame and further has a first attachment member configured to engage and rest on the first flange. The first attachment member also has a second flange. A plurality of second inserts is provided, each having a second attachment member configured to engage and selectively rest on the second flange. The container member of the first insert is configured to contain and hold the plurality of second inserts together and is removable from the perimeter frame so that the plurality of the second inserts can be taken as a unit to a location separate from the perimeter frame. The second inserts are also removable for individual use.

In yet another aspect, a freestanding storage system includes a perimeter frame made of polymeric material having sides with up flanges adapted to support hanging folders and with bottom-accessible recesses. A plurality of bent-wire legs is configured to snap-attach into the recesses of adjacent sides to support the universal frame. The legs include bottom foot sections shaped to stably engage a support surface.

These and other features, advantages, and objects of the present invention will be further understood and appreciated by those skilled in the art by reference to the following specification, claims and appended drawings.

DESCRIPTION OF THE DRAWINGS

FIGS. 7–9 are perspective views of three inserts adapted to sit within the storage unit shown in FIG. 1, FIG. 7 being a thin file folder insert, FIG. 8 being a sling insert, FIG. 9 being a soft box insert;

FIG. 10 is an exploded perspective view of a section of the attachment flange shown in FIG. 9;

FIG. 11 is an exploded perspective view similar to FIG. 10, but showing a section of a modified attachment flange;

FIG. 12 is a fragmentary cross section of a nested arrangement including the frame shown in FIG. 1, the soft box insert shown in FIG. 9, and a thin file folder insert shown in FIG. 7.

DETAILED DESCRIPTION OF PREFERRED EMBODIMENTS

Figure 13:
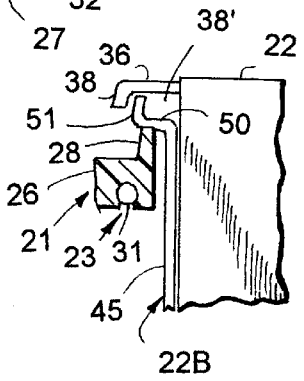
FIG. 13 is a perspective view of several supports for supporting the universal frame shown in FIG. 2.
Figure 14:
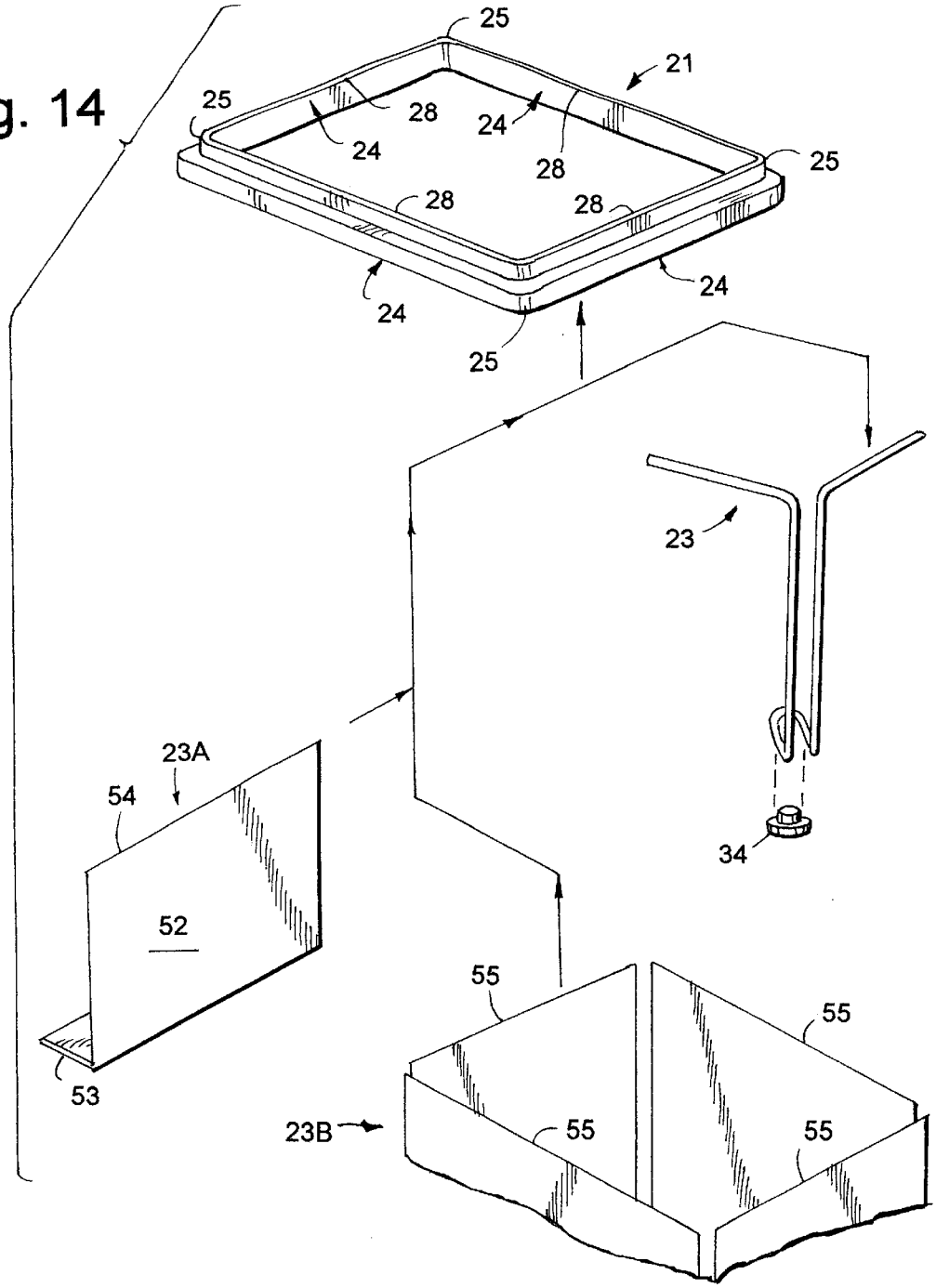
FIG. 14 is a perspective view of additional supports for supporting the universal frame shown in FIG. 2.

The present storage system includes a universal frame 21 adapted to support different inserts, such as inserts 22, 22A, and 22B (FIGS. 7–9, respectively), and is adapted to be supported by various supports 23, 23A and 23B (FIGS. 13 and 14). The storage system is knockdown and reconfigurable by a user, and provides excellent flexibility of use, while taking advantage of common parts. Further, the system can be flexibly used in existing offices having shelves or partitions.

Figure 1:
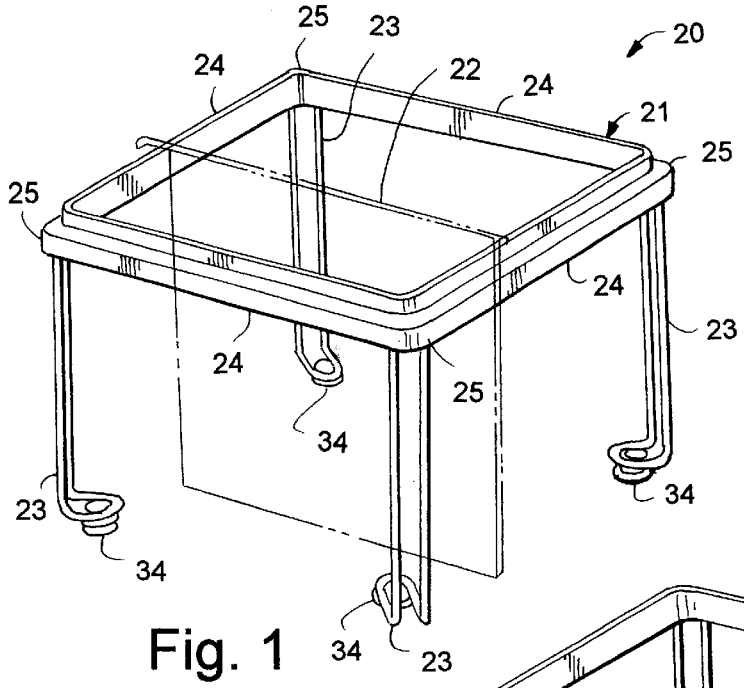
FIG. 1 is a perspective view of a knockdown storage device embodying the present invention.
Figure 6:
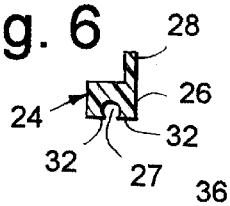
FIG. 6 is a cross section taken along the line VI—VI in FIG. 3.

The freestanding storage device 20 (FIGS. 1–3) includes the universal frame 21 supported by snap-attached legs 23. The illustrated universal frame 21 comprises a one piece molding of structure plastic, and includes straight side sections 24 and corners 25 forming a square (or rectangular) shape. The side sections 24 have a cross section (FIG. 6) that includes a body 26 with a bottom recess or groove 27, and a top flange 28 that extends above the body 26. The illustrated frame 21 is one piece, square, and has a flange 28 and also a recess 27 on all four sides, but it is contemplated that the frame could be multi-piece, rectangular, and have flanges 28 only on two opposing sides. The flange 28 is located on an inboard section of the body 26.

Figure 2:
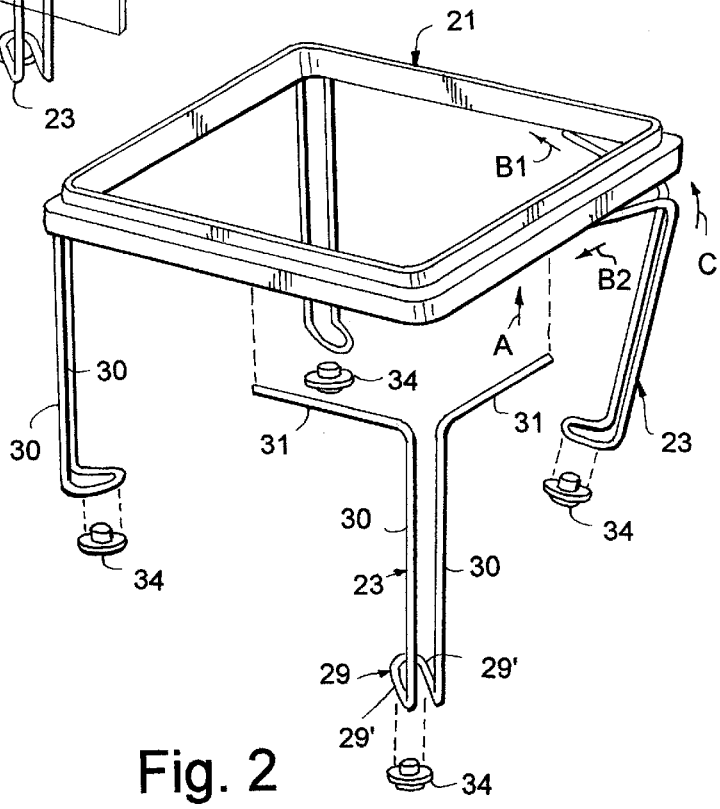
FIG. 2 is an exploded view of FIG. 1.
Figure 4:
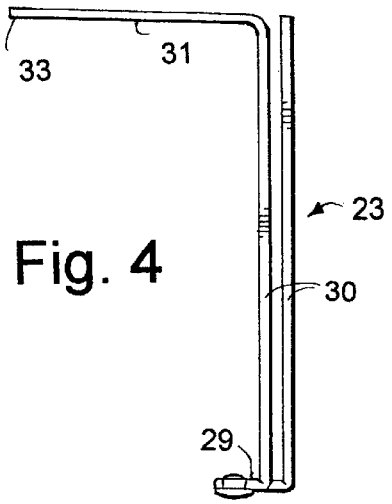
FIGS. 4–5 are side and top views of the bent-wire leg shown in FIG. 1.
Figure 5:
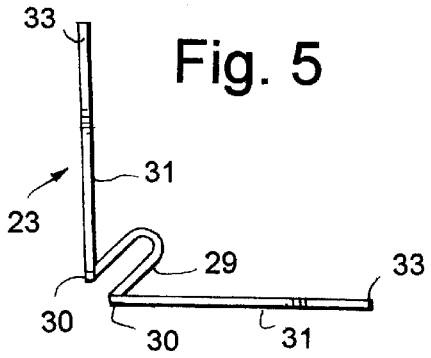
Figure 3:
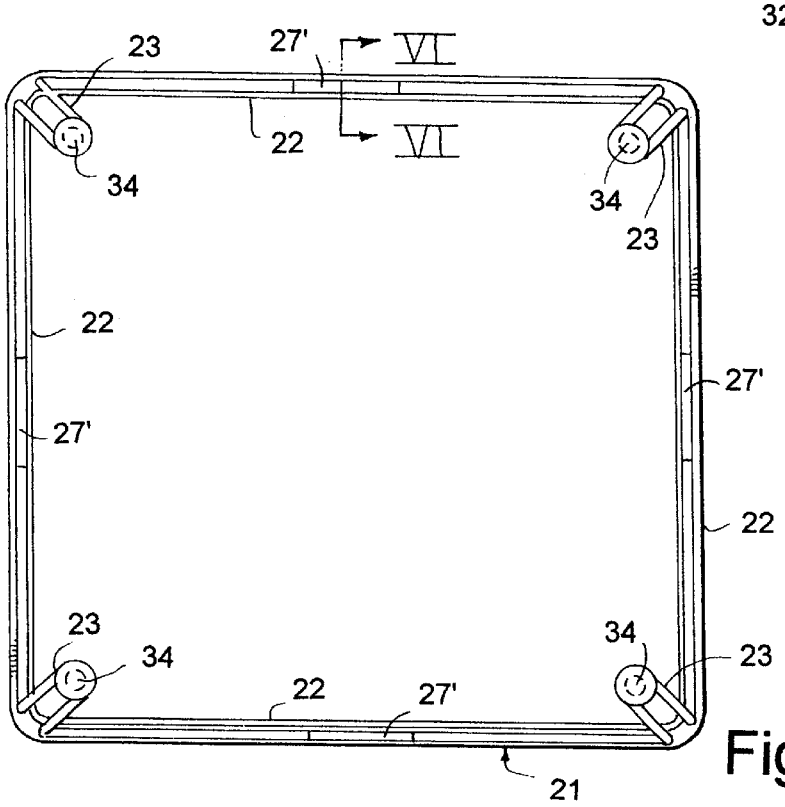
FIG. 3 is a bottom view of FIG. 1.

There are four bent-wire legs 23 shown in FIG. 2. Each bent-wire leg 23 includes a U-shaped foot section 29, parallel vertical sections 30, and orthogonally-related horizontal attachment sections 31. The attachment sections 31 are straight, and define a diameter shaped to snap-fit mateably into the recess 27 on the body 26. It is contemplated that the recess 27 defines a diameter about equal to the diameter of the bent-wire attachment sections 31, and further the opposing lips 32 that define an opening to the recess 27 are positioned closer together than the recess. When the attachment sections 31 are pressed against the opening to the recess 27 in a first direction "A" (FIG. 2), the lips 32 resiliently flex apart, allowing the attachment sections 31 to snap into the recess 27. When the lips 32 resiliently flex back toward each other, they retain the attachment sections 31 in place.

It is noted that the lips 32 do not need to extend a full length of the side sections 24 and further that they do not need to extend around the corners 25. Further, the side sections 24 can include center portions where there is no recess (e.g. the location 27' between the ends 33 of attachment sections 31 on adjacent pairs of bent-wire legs 23). Alternatively, the side sections 24 can include longitudinally-extending holes (not specifically shown) in their center portions for receiving the ends 33 of the attachment sections 31. In this second configuration with holes, the ends 33 of the bent-wire legs 23 are first extended into the holes in a first directions B1 and B2 (FIG. 2), and thereafter the bent-wire leg 23 is moved in a direction "C" to finally snappingly engage the leg 23 with the frame 21.

The U-shaped foot sections 29 (FIG. 2) each include parallel wire portions 29' that define a space therebetween, and further define an access opening into the space under the parallel vertical sections 30. A rubber foot 34 includes a disk-shaped lower end and a projection that extends upwardly. The projection is shaped to slide through the access opening into the space into frictional engagement with the parallel wire portions 29'. The foot 34 frictionally engages the parallel wire portions 29' to retain the foot 34 in the space.

The freestanding storage device 20 (FIG. 1) is adapted to support file folders 22. Specifically, the file folders 22 (FIG. 7) include a folded panel 35, with upper edges folded over and secured around flat wire hanger members 36. The folded panel 35 has a width selected to drop into and between the side sections 24, and the hanger members 36 each include end sections 37 (FIG. 1) that extend over the top flanges 28. A down hook 38 defines a recess 38' (FIG. 13) shaped to mateably receive and engage the top flange 28 to hold the file folder 22 in the frame 21. The illustrated frame 21 is square, such that the file folder 22 can be stored in either direction, but it is specifically noted that the frame 21 can be made in a rectangular shape. For example, it may be desirable to make two frames that are rectangular, and that combine to form a square when placed side by side.

The insert 22A (FIG. 8) includes a pair of molded attachment members 38" and a strip 39 of flexible material attached between and forming a sling between the attachment members 38". The attachment members 38" (FIG. 10) each include a down flange 40 and an up flange 41. The up flange 41 forms an inverted J-shaped hook for releasably engaging the top flange 28. The down flange 40 (FIG. 10) fits between a pair of tri-folded strips 42' on the end of the strip 39, and is secured in place by stitching. An extended section 40' of the down flange 40 extends into an end pocket formed by the tri-folded strips 42' of the strip 39 to stiffen the end area. Also, an additional stiffener (not shown) can be sewn to the edges of the flexible strip 39 if needed.

In an alternative embodiment (FIG. 11), an upper edge section of the strip 39 is folded to form a folded upper edge, and is slit along the folded edge to form an opening 42. The down flange 40 extends into the opening 42, and is secured such as by stitching.

The insert 22B (FIG. 9) includes a soft box 44 and a pair of attachment members 45. The soft box 44 includes a flat bottom panel 46 that is preferably relatively stiff, and four "soft" pliable side panels 47. The attachment members 45 include a down flange 48 and an up flange 49. The down flange 48 is attached to the side panels 47 of soft box 44 in a manner similar to the down flanges 40 as shown in FIG. 10 or as shown in FIG. 11. The up flange 49 comprises a modified L-shape (FIG. 12) including a horizontal leg 50 and a vertical leg 51 (see FIG. 13). The horizontal leg 50 extends far enough to stably engage and rest on the top flange 28. As shown, it is not necessary for the horizontal leg 50 to include a recess to engage a top of the top flange 28, although it potentially could. The vertical leg 51 is oriented and positioned to support the file folder 22 by engaging the recess 38' inside of the down hook 38. Thus, the soft box insert 22B is configured to rest on the frame 21, and to retain file folders 22 therein. It is contemplated to be within the scope of the present invention to provide a rigid box-shaped insert (like the insert 22B but with rigid sides and bottom).

The support 23A (FIG. 14) includes a pair of rigid panels 52 of wood, steel, plastic, or other suitable structural material. A top edge 54 of the panel 52 is configured to stably engage the recess 27 of the universal frame 21. Each of the side panels 52 include a bottom flange 53 configured for secure attachment to a shelf, such as with a bolt or tab-attach feature.

The support 23B (FIG. 14) includes a rigid box having rigid side panels 55 (of wood, steel, plastic, or the like) similar to the support 23A. In other words, like support 23A, the top edges of side panels 55 are configured to stably engage the recess 27 of the universal frame 21. The illustrated side panels 55 in the support 23B are not connected, but instead include separated corners. This helps in assembly. Nonetheless, a box support with connected corners could also be used.

In the foregoing description, it will be readily appreciated by those skilled in the art that modifications may be made to the invention without departing from the concepts disclosed herein. Such modifications are to be considered as included in the following claims, unless these claims by their language expressly state otherwise.

The invention claimed is:

1. A storage system for supporting items in a hanging folder, comprising:

a unitary frame made of polymeric material and defining a planar geometric shape with a plurality of sides, the unitary frame being a one-piece single molding that defines an opening and a continuous perimeter around the opening, at least two of the sides having an up flange adapted to support opposite edges of the hanging folder, the geometric shape further including corners having an attachment feature in the form of a recess molded into the unitary frame; and legs configured to releasably engage the attachment feature and support the unitary frame above a support surface in a free-standing arrangement, the legs having a length chosen to support the unitary frame above the support surface, whereby folders shorter than the length will not touch the support surface but instead will hang within the unitary frame.

2. The storage system defined in claim 1, wherein the recess extends from the corners onto the plurality of sides, and wherein the legs each include an upper end shaped to snap-attach into the recess.

3. The storage system defined in claim 2, wherein the upper ends each include wire sections that extend at a ninety degree angle to each other and that are shaped to snap into the recess in adjacent ones of the sides.

4. The storage system defined in claim 3, wherein the recesses form a continuous groove that extends around a bottom of the unitary frame.

5. The storage system defined in claim 4, wherein the up flange extends continuously around the unitary frame.

6. The storage system defined in claim 1, wherein the legs each include an upper end shaped to frictionally engage and attach to the attachment feature at each corner.

7. The storage system defined in claim 1, wherein the attachment feature at each corner extends from the associated corner and extends onto the sides adjacent the associated corner, and wherein the legs each include upper ends formed by wire sections that extend at a ninety degree angle to each other and that are shaped to frictionally engage the attachment features in the adjacent associated sides.

8. The storage system defined in claim 1, wherein the attachment feature comprises a continuous groove that extends around a bottom of the unitary frame.

9. The storage system defined in claim 1, wherein the up flange extends continuously around the unitary frame.

10. The storage system defined in claim 1, including a plurality of hanging inserts shaped to fit into and hang from the unitary frame, each hanging insert having a pair of attachment members adapted to engage the up flanges; the plurality of hanging inserts including a hanging folder with a folded stiff material forming a thin pocket for papers, a sling including a strip of flexible material that drapes between the at least two sides when placed in the unitary frame, and a box-shaped holder with four sides and a bottom configured to form a contained arrangement within the unitary frame.

11. The storage system defined in claim 10, wherein the sling is configured to hang perpendicular to the hanging folder when supported within the unitary frame.

12. The storage system defined in claim 10, wherein the box-shaped holder is configured to receive a plurality of the hanging folders.

13. A storage system comprising:

a unitary frame having a first up flange adapted to support hanging folders;

a first insert having a container member configured sit within the universal frame and further having a first attachment member configured to engage and rest on the first up flange, the first attachment member having a second up flange configured to replicate the first up flange; and a plurality of second inserts each having a second attachment member configured to engage and selectively rest on either one of the first up flange said plurality of second inserts together and being removable from the unitary frame so that the plurality of second inserts can be taken as a unit to a location separate from the unitary frame.

14. A storage system comprising:

a perimeter frame having a first flange adapted to engage and support hanging folders;

a first insert having a container member configured to set within the perimeter frame and further having an first attachment member configured to engage and rest on the first flange, the first attachment member having a second flange; and a plurality of second inserts each having a second attachment member configured to engage and selectively rest on the second flange, the container member of the first insert containing and holding said plurality of second inserts together and being removable from the perimeter frame so that the plurality of second inserts can be taken as a unit to a location separate from the perimeter frame, but the second inserts also being removable for individual use.

15. The storage system defined in claim 14, including:

a plurality of bent-wire legs configured to snap-attach into recesses in the perimeter frame; the legs including bottom foot sections shaped to stably engage a support surface.

16. The storage system defined in claim 15, wherein the perimeter frame comprises a unitary one-piece molding.

17. The storage system defined in claim 15, wherein the up flange comprises a continuous up flange that extends continuously around the perimeter frame.

* * * * *

UNITED STATES PATENT AND TRADEMARK OFFICE

CERTIFICATE OF CORRECTION

PATENT NO. : 6,279,762 B1
DATED : August 28, 2001
INVENTOR(S) : Buchalter et al.

It is certified that error appears in the above-identified patent and that said Letters Patent is hereby corrected as shown below:

Column 6,
Line 16, before "sit" insert -- to --;
Line 25, after "flange" insert -- and the second up flange, the container member of the first insert containing and holding --.

Signed and Sealed this

Twenty-fifth Day of June, 2002

*Attest:*

*Attesting Officer*

JAMES E. ROGAN
*Director of the United States Patent and Trademark Office*